United States Patent [19]

DiEdwardo et al.

[11] 4,112,059

[45] Sep. 5, 1978

[54] PROCESS FOR THE PRODUCTION OF CARBON FILAMENTS UTILIZING AN ACRYLIC PRECURSOR

[75] Inventors: Andrew H. DiEdwardo, Parsippany; Robert Dix, Wayne, both of N.J.

[73] Assignee: Celanese Corporation, New York, N.Y.

[21] Appl. No.: 523,764

[22] Filed: Nov. 14, 1974

[51] Int. Cl.[2] ..... D01F 9/12; D01F 9/22

[52] U.S. Cl. ..... 423/447.6; 264/29.2; 423/447.4

[58] Field of Search ..... 423/447, 447.6, 447.1, 423/447.2, 447.4, 447.8; 264/29, 29.2

[56] References Cited

U.S. PATENT DOCUMENTS

| | | | |
|---|---|---|---|
| 2,799,915 | 7/1957 | Barnett et al. | 423/447 X |
| 3,413,094 | 11/1968 | Gibson | 423/447 |
| 3,508,874 | 4/1970 | Rulison | 423/447 |
| 3,539,295 | 11/1970 | Ram | 423/447 |

FOREIGN PATENT DOCUMENTS

| | | | |
|---|---|---|---|
| 38-20,610 | 5/1963 | Japan | 423/447 |
| 1,222,881 | 2/1971 | United Kingdom | 423/447 |

*Primary Examiner*—Edward J. Meros
*Attorney, Agent, or Firm*—Kenneth A. Genoni

[57] ABSTRACT

An improved overall process is provided for producing carbon filaments beginning with a multifilament acrylic precursor. The process facilitates the thermal transformation of the acrylic fibrous material in the absence of undesirable coalescence between adjoining filaments. An extremely thin deposition of colloidal silica initially is provided upon the surface of the multifilament acrylic precursor (as described), the fibrous material thermally stabilized in the absence of coalescence (as described), the colloidal silica substantially removed, and the thermally stabilized fibrous material carbonized (as described). The resulting carbon filaments exhibit improved physical properties and particularly are suited for use as fibrous reinforcement in a resinous matrix.

10 Claims, No Drawings

PROCESS FOR THE PRODUCTION OF CARBON FILAMENTS UTILIZING AN ACRYLIC PRECURSOR

BACKGROUND OF THE INVENTION

In the search for high performance materials, considerable interest has been focused upon carbon fibers. The term "carbon fibers" is used herein in its generic sense and includes graphite fibers as well as amorphous carbon fibers. Graphite fibers are defined herein as fibers which consist substantially of carbon and have a predominant x-ray diffraction pattern characteristic of graphite. Amorphous carbon fibers, on the other hand, are defined as fibers in which the bulk of the fiber weight can be attributed to carbon and which exhibit a substantially amorphous x-ray diffraction pattern. Graphite fibers generally have a higher Young's modulus than do amorphous carbon fibers and in addition are more highly electrically and thermally conductive.

Industrial high performance materials of the future are projected to make substantial utilization of fiber reinforced composites, and carbon fibers theoretically have among the best properties of any fiber for use as high strength reinforcement. Among these desirable properties are corrosion and high temperature resistance, low density, high tensile strength, and high modulus. Graphite is one of the very few known materials whose tensile strength increases with temperature. Uses for carbon fiber reinforced composities include aerospace structural components, rocket motor casings, deep-submergence vessels and ablative materials for heat shields on re-entry vehicles.

In the past procedures have been proposed and are generally known in the art for converting an acrylic fibrous precursor to an amorphous carbon form or to a graphitic carbon form which retains substantially the same fibrous configuration as the starting material. The acrylic fibrous material is first thermally stabilized, and then carbonized.

The thermal stabilization of acrylic fibers generally has been accomplished in the past by heating in an oxygen-containing atmosphere at a moderate temperature for an extended period of time. U.S. Pat. Nos. 2,799,915 to Barnett et al, 2,913,802 to Barnett, and 3,285,696 to Tsunoda are representative of early patents which disclose the conversion of fibers of acrylonitrile homopolymers or copolymers to a heat resistant form by heating in air. The stabilization of fibers of acrylonitrile homopolymers and copolymers in an oxygen-containing atmosphere involves (1) a chain scission and oxidative cross-linking reaction of adjoining molecules as well as (2) a cyclization reaction of pendant nitrile groups. The stabilized acrylic fibers commonly have a bound oxygen content of at least 7 percent by weight as determined by the Unterzaucher or other suitable analysis, and commonly contain about 50 to 65 percent carbon by weight.

Heretofore, fiber coalescence sometimes has been observed following the thermal stabilization reaction particularly when the acrylic precursor contains a substantial proportion of copolymerized monovinyl units with acrylonitrile groups, and/or when the stabilization reaction is carried out at a relatively high temperature. Such fiber coalescence leads to an ultimate carbon fiber product of reduced physical properties. The coalesced fibers tend to be stiff and to possess flaws at the point of coalescence even if the fibers are separated by force.

Commonly assigned U.S. Pat. No. 3,508,874 to Rulison discloses a technique for overcoming fiber coalescence by providing powdered graphite or carbon black upon the surface of the fibrous material.

An alternate approach for forming carbonized fibers directly from acrylic fibers while coated with a refractory barrier is proposed in U.S. Pat. Nos. 3,242,000 and 3,281,261 to Lynch.

It is an object of the present invention to provide an improved process for the production of carbon filaments beginning with an acrylic multifilament precursor.

It is an object of the present invention to provide an improved process for the production of carbon filaments from an acrylic multifilament precursor wherein coalescence of adjoining filaments during the thermal stabilization portion of the process effectively is eliminated.

It is an object of the present invention to provide an improved process for the production of a carbonaceous fibrous material which particularly is suitable for use as a fibrous reinforcement in a resinous matrix.

It is another object of the present invention to provide an improved process for the production of a carbonaceous fibrous material wherein the stabilization portion thereof may be conducted on a more economical basis through the use of a lesser residence time and a more highly elevated stabilization temperature in the absence of fiber coalescence.

It is another object of the present invention to provide an improved process for the production of carbon filaments from an acrylic multifilament precursor wherein a final product exhibiting superior physical properties is formed.

It is a further object of the present invention to provide an improved process for the production of carbon filaments from an acrylic multifilament precursor which satisfactorily may be carried out without fiber coalescence while employing a polymeric precursor containing a substantial quantity of copolymerized monovinyl units and/or a relatively high thermal stabilization temperature.

These and other objects, as well as the scope, nature, and utilization of the invention, will be apparent from the following detailed description and appended claims.

SUMMARY OF THE INVENTION

It has been found that an improved process for the production of a multifilament carbonaceous fibrous material which is suitable for use as a fibrous reinforcement in a resinous matrix comprises:

(a) contacting a multifilament acrylic fibrous material selected from the group consisting of an acrylonitrile homopolymer and acrylonitrile copolymers containing at least about 85 mol percent acrylonitrile units and up to about 15 mol percent of one or more monovinyl units copolymerized therewith with a liquid medium comprising a dispersion of colloidal silica having number average particle size of about 5 to 50 millimicrons in a $C_1$ to $C_3$ alkanol, (b) drying the resulting fibrous material under conditions wherein the $C_1$ to $C_3$ alknaol is substantially evolved from the fibrous material and the colloidal silica is deposited upon the surface of the fibrous material in a concentration of about 0.001 to 0.6 percent by weight based upon the weight of the fibrous material, (c) thermally stabilizing the fibrous material bearing the colloidal silica upon its surface by heating in an oxygen-containing gaseous atmosphere at a temperature of about 230° to 300° C. in the absence of filament coalescence to form a fibrous material which retains its original configuration substantially intact, is non-burning when subjected to an ordinary match flame, and is capable of undergoing carbonization, (d) substantially removing the colloidal silica from the fibrous material, and (e) heating the resulting thermally stabilized fibrous material in a non-oxidizing gaseous atmosphere at a temperature of at least 1000° C. until a carbonized fibrous material containing at least 90 percent carbon by weight is formed.

DESCRIPTION OF PREFERRED EMBODIMENTS

The multifilament acrylic fibrous material selected for use as the precursor in the present process may be formed by conventional solution spinning techniques (i.e. may be dry spun or wet spun), and commonly is drawn to increase its orientation. As is known in the art, dry spinning commonly is conducted by dissolving the polymer in an appropriate solvent, such as N,N-dimethylformamide or N,N-dimethylacetamide, and passing the solution through an opening of predetermined shape into an evaporative atmosphere (e.g. nitrogen) in which much of the solvent is evaporated. Wet spinning commonly is conducted by passing a solution of the polymer through an opening of predetermined shape into an aqueous coagulation bath.

The acrylic polymer utilized as the starting materials is formed primarily of recurring acrylonitrile units. For instance, the acrylic polymer may be an acrylonitrile homopolymer or acrylonitrile copolymers containing at least about 85 mol percent acrylonitrile units and up to about 15 mol percent of one or more monovinyl units copolymerized therewith. Representative monovinyl units may be derived from styrene, methyl acrylate, methyl methacrylate, vinyl acetate, vinyl chloride, vinylidene chloride, vinyl pyridine, and the like.

The process of the present invention is particularly suited for use with those acrylic precursor materials which exhibit an increased propensity to coalesce at elevated temperatures, e.g. an acrylonitrile copolymer containing about 85 to 95 mol percent acrylonitrile units and about 5 to 15 percent of one or more monovinyl units copolymerized therewith.

The multifilament acrylic precursor may be provided in a woven or non-woven form (e.g. as a continuous length of fibrous material which is not assembled as a fabric or textile). For instance, the multifilament acrylic fibrous material may be present in the form of a continuous length of yarn, tow, tape, strand, cable, or similar fibrous assemblage.

When the starting material is a continuous multifilament yarn a twist may be imparted to the same to improve the handling characteristics. For instance, a twist of about 0.1 to 5 tpi, and preferably about 0.3 to 1.0 tpi may be utilized. Also a false twist may be used instead of or in addition to a real twist. Alternatively, one may select bundles of fibrous material which possess essentially no twist.

The starting material may be drawn in accordance with conventional techniques in order to improved its orientation. For instance, the starting material may be drawn by stretching while in contact with a hot shoe at a temperature of about 140° to 160° C. Additional representative drawing techniques are disclosed in U.S. Pat. Nos. 2,455,173; 2,948,581; and 3,122,412. It is recommended that the acrylic fibrous materials selected for use in the process be drawn to a single filament tenacity of at least about 3 grams per denier. If desired, however, the starting material may be more highly oriented, e.g. drawn up to a single filament tenacity of about 7.5 to 8 grams per denier, or more. Stabilization or carbonization promoting catalysts optionally may be included within the multifilament acrylic fibrous material.

The multifilament acrylic fibrous material is contacted with a dispersion of colloidal silica having a number average particle size of about 5 to 50 millimicrons (preferably about 5 to 10 millimicrons) in a $C_1$ to $C_3$ alkanol. The particle size may be determined by utilizing standard electron microscope analysis techniques. The contact conveniently may be carried out by simply immersing the multifilament acrylic fibrous material in the dispersion of colloidal silica under conditions wherein the individual filaments are substantially exposed to the same. For instance, a continuous length of the multifilament fibrous material may be continuously passed through a vessel containing the dispersion of colloidal silica. Alternatively, the multifilament acrylic fibrous material may be wound upon a support in a limited thickness and statically immersed in the dispersion. Also, the contact may be carried out employing various spray techniques.

The colloidal silica utilized in the process possessing the requisite particle size is commercially available and may be of the usual industrial grade. The silica may be either hydrophobic, hydrophilic, or partially hydrophobic and partially hydrophilic in nature. A preferred colloidal silica for use in the process is prepared by the combustion of silicon tetrachloride in a hydrogen oxygen furnace and commonly is termed "fumed silica". Representative commercially available colloidal silica products are marketed by Degussa, Inc. under the designation Aerosil silica, and by the Cabot Corporation under the designation of Cab-O-Sil silica. Th colloidal silica particles as described commonly exhibit a surface area of about 50 to 350 square meters per gram as determined by standard BET analysis.

The liquid medium in which the colloidal silica is dispersed during the contact with the acrylic precursor is non-aqueous in nature. The non-aqueous liquid medium facilitates a highly uniform dispersion of the colloidal silica which is essential in the accomplishment of the desired extremely thin deposition as described hereafter. $C_1$ to $C_3$ alkanols, such as methanol, ethanol, and isopropanol conveniently may be utilized. The preferred alkanol for use in the process is isopropanol. If desired, a minor quantity of surface active agent optionally may be included in the liquid medium to aid in the dispersion of the colloidal silica.

The residence time during which the multifilament acrylic fibrous material is contacted with the dispersion of colloidal silica will vary with the concentration of the colloidal silica in the dispersion and the relative compactness of the adjoining filaments. In a preferred embodiment of the process the colloidal silica is provided in the liquid medium (e.g. isopropanol) in a concentration of about 0.002 to 1.0 percent by weight based upon the weight of the liquid medium. Contact residence times during which the multifilament acrylic fibrous material is immersed in the liquid medium commonly range from about 0.5 to 5 seconds. Different colloidal silica concentrations in the liquid medium and different residence times may be utilized so long as the desired extremely thin deposition of colloidal silica is accomplished. The liquid medium conveniently may be provided at ambient temperature when contacted with the multifilament acrylic fibrous material.

If desired, excess dispersion initially may be removed from the fibrous material by passage through a pair of nip rollers (i.e. squeeze rollers) prior to drying.

Following contact with the dispersion of colloidal silica, the resulting fibrous material is dried under conditions wherein the $C_1$ to $C_3$ alkanol is substantially evolved, and a substantially uniform deposition of colloidal silica is provided upon the surface of the fibrous material in a concentration of about 0.001 to 0.6 percent by weight based upon the weight of the fibrous material. In a particularly preferred embodiment of the process the colloidal silica is deposited upon the surface of the fibrous material in a concentration of about 0.005 to 0.4 percent by weight based upon the weight of the fibrous material. The drying step may be conducted in any convenient manner. For instance, the fibrous material may be simply exposed to ambient conditions until the liquid medium adhering thereto is substantially evaporated. The drying step can, of course, be expedited by exposure to a circulating gaseous atmosphere provided at an elevated temperature, as will be apparent to those skilled in the art. If desired, the drying conveniently may be conducted in the same zone in which the stabilization reaction is carried out.

One optionally may hot draw the fibrous material bearing the colloidal silica without any substantial loss thereof prior to thermal stabilization in order to increase the orientation thereof and to reduce the denier per filament.

The fibrous material bearing the colloidal silica upon its surface next is thermally stabilized by heating in an oxygen-containing gaseous atmosphere at a temperature of about 230° C. to 300° C. in the absence of filament coalescence to form a fibrous material which retains its original configuration substantially intact, is non-burning when subjected to an ordinary match flame, and is capable of undergoing carbonization. Air conveniently may be utilized as the oxygen-containing gaseous atmosphere.

For best results uniform contact during the stabilization reaction with molecular oxygen throughout all portions of the acrylic fibrous material is encouraged. Such uniform reaction conditions can best be accomplished by limiting the mass of fibrous material at any one location so that heat dissipation from within the interior of the fibrous material is not unduly impaired, and free access to molecular oxygen is provided. For instance, the acrylic fibrous material may be placed in the oxygen-containing atmosphere while wound upon a support to a limited thickness. In a preferred embodiment of the invention the acrylic fibrous material continuously passed in the direction of its length through the heated oxygen-containing atmosphere. For instance, a continuous length of the acrylic fibrous material may be passed through a circulating oven or the tube of a muffle furnace. The speed of passage through the heated oxygen-containing atmosphere will be determined by the size of the heating zone and the desired residence time.

The period of time required to complete the stabilization reaction within the oxygen-containing atmosphere generally is inversely related to the temperature of the atmosphere, and also is influenced by the denier of the acrylic fibrous material undergoing treatment. For instance, an acrylonitrile homopolymer fibrous material having a denier per filament of about 1 to 2 and bearing the colloidal silica upon its surface (as described) may be heated in an oxygen-containing atmosphere provided at a temperature of about 260° to 300° C. for about 15 to 120 minutes. Commonly, an acrylonitrile copolymer containing about 85 to 95 mol percent acrylonitrile units and about 5 to 15 mol percent of one or more monovinyl units copolymerized therewith having a denier per filament of about 1 to 2 and bearing th colloidal silica upon its surface (as described) may be stabilized in an oxygen-containing atmosphere provided at a temperature of about 230° to 300° C. within about 45 to 360 minutes. A temperature profile may be utilized during the thermal stabilization reaction wherein the fibrous material is at least initially heated at the lower end of the temperature range. Such moderate initial heating is recommended particularly when the precursor is an acrylonitrile copolymer. The presence of the extremely thin deposition of colloidal silica upon the fibrous material prevents deleterious coalescence between adjoining filaments which may otherwise occur during the stabilization reaction. Also, the flow of oxygen between the individual filaments is more readily facilitated since the silica particles serve to separate the adjoining filaments and to enable the exothermic heat of reaction to be removed from the fibers via air flow.

Following thermal stabilization the deposition of colloidal silica is substantially removed by any convenient technique. In a preferred embodiment of the process the removal is carried out by washing in a detergent solution utilizing a commercially available ultrasonic wash bath. The removal of the colloidal silica enables the ultimate formation of a carbonaceous fibrous material having an exposed surface capable of bonding to a resinous matrix material without interference from the silica.

The stabilized multifilament acrylic fibrous material may be converted to improved carbon filaments at a more highly elevated temperature of at least 1000° C., e.g. 1000° to 2,000° C., or more, in a non-oxidizing atmosphere. Preferred non-oxidizing atmospheres are nitrogen, argon, and helium. The stabilized fibrous material is subjected to such highly elevated temperature until carbon filaments containing at least 90 percent carbon by weight are formed, and preferably until carbon filaments containing at least 95 percent carbon by weight are formed. In a more particularly preferred embodiment, carbon filaments containing at least 98 percent carbon are formed. When the fibrous material ultimately is heated to a temperature of about 2000° C. or above then a carbonized and graphitized multifilament fibrous material is formed.

The process of the present invention provides an improved route for the production of carbon filaments from a multifilament acrylic precursor. The extremely thin deposition of colloidal silica effectively prevents coalescence of adjoining filaments during the stabilization reaction thereby leading to the formation of a product exhibiting improved physical properties. Also, the presence of the deposition of colloidal silica (as described) enables the stabilization reaction to be carried out on a more expeditious basis since more highly elevated temperatures can be tolerated by the acrylic precursor. The minute quantity of colloidal silica utilized during the stabilization reaction readily may be removed, and therefore does not interfere with the carbonization reaction or subsequent end uses for the product. Accordingly, the product is capable of undergoing unobstructed bonding with a resinous matrix material when forming a carbon fiber reinforced composite article.

The following example is given as a specific illustration of the invention. It should be understood, however, that the invention is not limited to the specific details set forth therein.

A continuous length of a 40,000 fil dry spun continuous filament acrylonitrile copolymer tow having a total denier of 120,000 is selected as the starting material. The precursor is commercially available from DuPont under the designation of Orlon acrylic fiber and contains about 95 mol percent acrylonitrile units and about 5 mol percent copolymerized methylacrylate units. The tow exhibits a single filament tenacity of about 2.8 grams per denier.

The tow continuously is passed in the direction of its length through a dispersion of colloidal silica having an average particle size of 10 millimicrons present in isopropanol in a concentration of about 0.4 percent by weight based upon the weight of isopropanol. The colloidal silica is commercially available from Degussa, Inc. under the designation of Aerosil silica. The dispersion is provided at a temperature of about 20° C. and the tow is immersed therein for about 3 seconds.

The resulting tow next is passed through a pair of nip rollers at a pressure of 40 psi wherein excess dispersion adhering to the same is removed, and is passed around an internally heated roller whereby the remaining isopropanol substantially is evolved. A substantially uniform deposition of colloidal silica is provided upon the surface of the fibrous material in a concentration of about 0.3 percent by weight based upon the weight of the tow.

The resulting dried tow bearing the film of colloidal silica next is hot drawn at a draw ratio of 2:1 to yield a fibrous material having a denier per filament of about 1.5 and a single filament tenacity of about 4.5 without any substantial loss of the colloidal silica present thereon.

Following collection upon a Barmag winder the tow bearing the colloidal silica upon its surface continuously is passed for a residence time of about 5 minutes through an optional pretreatment zone provided with an air atmosphere at 190° C. wherein it is allowed to shrink about 5 percent of its original length.

The fibrous material bearing the colloidal silica upon its surface next continuously is passed for 6 hours through a thermal stabilization zone provided with a circulating air atmosphere at 240° C. While passing through the stabilization zone, the tow is directed by pairs of parallel rollers. While present in the stabilization zone, no coalescence occurs between adjoining filaments. The resulting stabilized product retains its original configuration substantially intact, is flexible, and is non-burning when subjected to an ordinary match flame.

The extremely thin deposition of colloidal silica is removed from the thermally stabilized tow by washing in an aqueous detergent solution in a conventional ultrasonic wash bath. The stabilized tow is washed with water and is dried.

The resulting thermally stabilized tow is carbonized and graphitized by passage through the graphite susceptor of an induction furnace provided with a circulating nitrogen atmosphere wherein it is heated to a maximum temperature of 1800° C. to form a product containing about 99 percent carbon by weight which exhibits highly satisfactory physical properties. More specifically, the product exhibits a single filament tenacity of 19.5 grams per denier, and a single filament Young's modulus of 1800 grams per denier.

In a comparative example wherein the deposition of colloidal silica is omitted it is observed that substantial coalescence occurs between filaments during the stabilization reaction. The resulting product is stiff and breaks when carbonization is attempted in the induction furnace.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. An improved process for the production of a multifilament carbonaceous fibrous material which is suitable for use as a fibrous reinforcement in a resinous matrix consisting essentially of:

(a) contacting a multifilament acrylic fibrous material selected from the group consisting of an acrylonitrile homopolymer and acrylonitrile copolymers containing at least about 85 mol percent acrylonitrile units and up to about 15 mol percent of one or more monovinyl units copolymerized therewith with a liquid medium comprising a dispersion of colloidal silica having a number average particle size of about 5 to 50 millimicrons in a $C_1$ to $C_3$ alkanol in a concentration of about 0.002 to 1.0 percent by weight based upon the weight of said alkanol, (b) drying said resulting fibrous material under conditions wherein said $C_1$ to $C_3$ alkanol is substantially evolved from said fibrous material and said colloidal silica is deposited upon the surface of said fibrous material in a concentration of about 0.005 to 0.4 percent by weight based upon the weight of said fibrous material, (c) thermally stabilizing said fibrous material bearing said colloidal silica upon its surface by heating in a gaseous atmosphere consisting of air at a temperature of about 230° to 300° C. in the absence of filament coalescence to form a flexible fibrous material which retains its original configuration substantially intact, is non-burning when subjected to an ordinary match flame, and is capable of undergoing carbonization, (d) substantially removing said colloidal silica from said fibrous material, and (e) heating said resulting thermally stabilized fibrous material in a non-oxidizing gaseous atmosphere selected from the group consisting of nitrogen, argon, and helium at a temperature of at least 1000° C. until a carbonized fibrous material containing at least 90 percent carbon by weight is formed.

2. An improved process for the production of a multifilament carbonaceous fibrous material in accordance with claim 1 wherein said fibrous material is an acrylonitrile homopolymer.

3. An improved process for the production of a multifilament carbonaceous fibrous material in accordance with claim 1 wherein said fibrous material is an acrylonitrile copolymer containing about 85 to 95 mol percent acrylonitrile units and about 5 to 15 mol percent of one or more monovinyl units copolymerized therewith.

4. An improved process for the production of a multifilament carbonaceous fibrous material in accordance with claim 1 wherein said fibrous material prior to step (c) has been drawn to a single filament tenacity of at least 3 grams per denier.

5. An improved process for the production of a multifilament carbonaceous fibrous material in accordance with claim 1 wherein said fibrous material is a continuous length of a multifilament yarn.

6. An improved process for the production of a multifilament carbonaceous fibrous material in accordance with claim 1 wherein said fibrous material is a continuous length of a multifilament tow.

7. An improved process for the production of a multifilament carbonaceous fibrous material in accordance with claim 1 wherein said alkanol is isopropanol.

8. An improved process for the production of a multifilament carbonaceous fibrous material in accordance with claim 2 wherein said fibrous material bearing said colloidal silica upon its surface is heated in said gaseous atmosphere consisting of air at a temperature of about 260° to 300° C. for about 15 to 120 minutes.

9. An improved process for the production of a multifilament carbonaceous fibrous material in accordance with claim 3 wherein said fibrous material bearing said colloidal silica upon its surface is heated in said gaseous atmosphere consisting of air at a temperature of about 230° to 300° C. for about 45 to 360 minutes.

10. An improved process for the production of a multifilament carbonaceous fibrous material in accordance with claim 1 wherein said colloidal silica is substantially removed from said fibrous material in step (d) via ultrasonic washing in a detergent bath.

* * * * *